US007938202B2

(12) United States Patent
Mitchell et al.

(10) Patent No.: US 7,938,202 B2
(45) Date of Patent: May 10, 2011

(54) ROTATING DRILL PIPE PROTECTOR ATTACHMENT AND FASTENER ASSEMBLY

(75) Inventors: Sarah B. Mitchell, Tustin, CA (US); Rudolph Ernst Krueger, IV, Cypress, CA (US); Garrett C. Casassa, Anaheim, CA (US)

(73) Assignee: WWT International, Inc., Houston, TX (US)

( * ) Notice: Subject to any disclaimer, the term of this patent is extended or adjusted under 35 U.S.C. 154(b) by 61 days.

(21) Appl. No.: 12/429,962

(22) Filed: Apr. 24, 2009

(65) Prior Publication Data

US 2009/0266618 A1 Oct. 29, 2009

Related U.S. Application Data

(60) Provisional application No. 61/125,547, filed on Apr. 24, 2008.

(51) Int. Cl.
*E21B 17/10* (2006.01)

(52) U.S. Cl. ..... 175/325.7; 166/241.6

(58) Field of Classification Search ..... 175/325.7; 166/241.4, 241.6

See application file for complete search history.

(56) References Cited

U.S. PATENT DOCUMENTS

| | | | | |
|---|---|---|---|---|
| 2,033,592 | A * | 3/1936 | Skeen | 175/325.7 |
| 2,197,531 | A | 1/1938 | Smith | |
| 2,657,956 | A | 11/1953 | Hall, Sr. | |
| 2,801,700 | A | 8/1957 | Hall, Sr. | |
| 3,180,436 | A | 4/1965 | Kellner et al. | |
| 3,397,017 | A * | 8/1968 | Taylor, Jr. et al. | 175/325.7 |

(Continued)

FOREIGN PATENT DOCUMENTS

EP 0 87 938 A2 8/1997

(Continued)

OTHER PUBLICATIONS

Notification of Transmittal of the International Search Report and the Written Opinion of the International Searching Authority, or the Declaration; for International Application No. PCT/US2008/003053; International Filing Date Mar. 6, 2008; Mailing Date Jul. 8, 2008.

(Continued)

*Primary Examiner* — William P Neuder
(74) *Attorney, Agent, or Firm* — Christie, Parker & Hale, LLP

(57) ABSTRACT

An attachment and fastener system rigidly secures a rotatable drill pipe protector (RDPP) to a drill pipe. The RDPP comprises a sleeve which is split axially along at least one side. Parallel hinge bars are contained in first and second hinge sections which wrap around the hinge bars along opposite sides of the opening in the RDPP. One hinge bar is rotatable in the first hinge section. A series of axially spaced apart bolts are held in corresponding threaded openings in the rotatable hinge bar which rotates about its axis to swing the bolts in unison between open and closed positions. The other hinge bar has a series of threaded receptor openings facing outwardly from slotted openings in the second hinge section and aligned with the bolts on the other hinge bar. The rotating hinge bar swings the bolts into alignment with the slotted openings in the other hinge, after which the bolts are tightened in the threaded receptor openings for applying a holding force around the drill pipe. The hinges which wrap around each hinge bar are formed on the ends of a reinforcing cage structure molded into the wall of the RDPP.

20 Claims, 6 Drawing Sheets

U.S. PATENT DOCUMENTS

| | | | |
|---|---|---|---|
| 3,491,182 | A | 1/1970 | Hunder et al. |
| 3,754,609 | A | 8/1973 | Garrett |
| 3,820,611 | A | 6/1974 | King |
| 3,948,575 | A | 4/1976 | Rosser |
| 3,999,811 | A | 12/1976 | Gray |
| 4,099,564 | A | 7/1978 | Hutchison |
| 4,171,560 | A | 10/1979 | Garrett |
| 4,199,011 | A | 4/1980 | Kreft et al. |
| 4,258,804 | A | 3/1981 | Richey et al. |
| 4,274,840 | A | 6/1981 | Housman |
| 4,379,494 | A | 4/1983 | Sheshtawy |
| 4,384,483 | A | 5/1983 | Dellinger et al. |
| 4,436,118 | A | 3/1984 | Garrett |
| 4,458,404 | A | 7/1984 | Garrett |
| 4,601,334 | A | 7/1986 | Lovegrove |
| 4,603,982 | A | 8/1986 | Dittrich |
| 4,634,314 | A | 1/1987 | Pierce |
| 4,674,580 | A | 6/1987 | Schuh et al. |
| 4,708,203 | A | 11/1987 | Walker |
| 5,009,826 | A | 4/1991 | Walker |
| 5,046,558 | A | 9/1991 | Koster |
| 5,069,297 | A | 12/1991 | Krueger et al. |
| 5,132,069 | A | 7/1992 | Newton |
| 5,332,049 | A | 7/1994 | Tew |
| 5,363,929 | A | 11/1994 | Williams et al. |
| 5,364,909 | A | 11/1994 | Guo et al. |
| 5,474,132 | A | 12/1995 | Gallagher |
| 5,604,266 | A | 2/1997 | Mushovic |
| 5,692,563 | A | 12/1997 | Krueger et al. |
| 5,803,193 | A | 9/1998 | Krueger et al. |
| 5,833,018 | A | 11/1998 | von Gynz-Rekowski |
| 5,833,019 | A | 11/1998 | Gynz-Rekowski |
| 5,866,218 | A | 2/1999 | Meuth |
| 5,901,798 | A | 5/1999 | Herrera et al. |
| 5,902,656 | A | 5/1999 | Hwang |
| 5,937,948 | A | 8/1999 | Robbins, III |
| 6,032,748 | A | 3/2000 | DeBray et al. |
| 6,250,405 | B1 | 6/2001 | Moore et al. |
| 6,250,406 | B1 * | 6/2001 | Luke ..... 175/325.2 |
| 6,378,633 | B1 | 4/2002 | Moore et al. |
| 6,467,557 | B1 | 10/2002 | Krueger et al. |
| 6,470,974 | B1 | 10/2002 | Moore et al. |
| 6,513,223 | B1 | 2/2003 | Angman et al. |
| 6,708,783 | B2 | 3/2004 | Moore et al. |
| 6,725,939 | B2 | 4/2004 | Richard |
| 6,739,415 | B2 | 5/2004 | Mitchell et al. |
| 6,942,044 | B2 | 9/2005 | Moore et al. |
| 7,055,631 | B2 | 6/2006 | Mitchell et al. |
| 7,195,730 | B2 | 3/2007 | Calderoni et al. |
| 2005/0224123 | A1 | 10/2005 | Baynham et al. |
| 2006/0062638 | A1 | 3/2006 | Bergeron et al. |
| 2006/0196036 | A1 | 9/2006 | Male et al. |
| 2006/0207768 | A1 * | 9/2006 | Angman et al. ..... 166/380 |
| 2007/0131414 | A1 | 6/2007 | Calderoni et al. |

FOREIGN PATENT DOCUMENTS

| | | | |
|---|---|---|---|
| GB | 117185 | | 7/1918 |
| GB | 2 282 615 | A | 4/1995 |
| GB | 2 400 124 | A | 10/2004 |
| GB | 2 423 739 | A | 9/2006 |
| WO | WO 02/02904 | A1 | 1/2002 |
| WO | WO 02/48501 | A1 | 6/2002 |

OTHER PUBLICATIONS

Notification of Transmittal of the International Search Report and the Written Opinion of the International Searching Authority, or the Declaration; for International Application No. PCT/US2009/041707; International Filing Date Apr. 24, 2009; Mailing Date Aug. 10, 2009.

* cited by examiner

ROTATING DRILL PIPE PROTECTOR ATTACHMENT AND FASTENER ASSEMBLY

CROSS-REFERENCE TO RELATED APPLICATION

This application claims the benefit of and priority to U.S. Provisional Application No. 61/125,547, filed on Apr. 24, 2008, the entire disclosure of which, including the appendix, is fully incorporated herein by this reference.

FIELD OF THE INVENTION

This invention relates to wear protectors for rotating drill pipes used in oil and gas exploration or recovery, and more particularly to rotating drill pipe protectors, those that are fixed to the rotating drill pipe and rotate with the drill pipe during use.

BACKGROUND OF THE INVENTION

When drilling oil and gas wells with rotary drilling equipment, the drill pipe frequently comes into contact with the well casing, resulting in wear to both the casing and the drill pipe. In addition, the friction between the drill pipe and casing may result in significant torque and drag, which can exceed the capability of the rig's drive system. Drill pipe protectors are commonly known in the industry. They generally comprise a protective sleeve made from a non-abrasive material secured to the drill pipe. The sleeve is positioned on the drill pipe so that the sleeve can contact the wall of the well casing or bore to prevent damaging contact between the rotating drill pipe and the casing or bore.

The prior art includes use of various types of rotating and non-rotating drill pipe protectors. The most prevalent rotating protector design uses a wedge-shaped stamped steel "wedge pin" which is driven into the hinge to close the protector around the drill pipe. Non-rotating drill pipe protectors (NRDDPs) are disclosed in several U.S. patents held by Western Well Tool, Inc. (WWT), including U.S. Pat. No. 5,069,297 to Krueger et al. These patents disclose techniques for producing a fluid bearing effect between the sleeve and the drill pipe so that the drill pipe can rotate relative to the protective sleeve during use.

The present invention is directed to rotating drill pipe protectors (RDPPs). These protectors are rigidly affixed to the drill pipe so they can rotate with the drill pipe during use. Generally speaking, these drill pipe protectors can be of lower cost than NRDPPs, particularly for use on land-based rigs. They can be effective in offering protection in applications involving moderate side loads. RDPPs must be designed to generate a substantial circumferential gripping strength that minimizes axial slippage between the sleeve and the drill pipe in response to side loads caused by contact forces between the sleeve and the well casing or bore during use. Low grip strength around the pipe can frequently result in the protector slipping on the pipe; and when the protectors move away from their installed position, they become ineffective at preventing wear. Also, problems are caused by the inability to strip through pressure control equipment, such as diverter assemblies, rotating pressure control heads, and BOPs, due to low grip strength. Once the protector has slipped, its structural integrity is too often inadequate to prevent serious failure of the protector, resulting in debris in the well.

The previously mentioned stamped steel wedge pin design produces low holding forces and leaves a significant portion of the pin remaining above the protector where it can hang-up on obstructions.

A frequent problem offshore is in drilling with a riser in deep water. Drill pipe in these conditions may wear the riser, well head, and BOP equipment at significant cost and rig downtime. Use of rotating protectors, properly positioned, can prevent such damage and economic loss. However, this is an extremely demanding application, requiring large holding forces for RDPPs.

The present invention provides a rotating drill pipe protector that resists slippage by a protector sleeve attachment and fastener assembly having improved gripping strength. Other improvements also are provided. One area of improvement has to do with preventing buckling of the drill string during use.

Buckling of drill pipe has been and remains a serious problem to drilling by reducing the drilling penetration, damaging drill pipe, and sometimes preventing reaching the reservoir. The typical indication of buckling is the buckled pipe preventing placing load onto the drill bit, thus preventing drilling. Buckling of drill pipe is typically described by the buckling load, i.e., the load when the pipe buckles.

The buckling load is affected by many parameters including length of the drill pipe between tool joints, drill pipe diameter, tool joint diameter, diameter of casing or open hole, the eccentricity of the drill pipe within the casing, the fluid (weight and lubricity), coefficient of friction between the drill pipe and casing in the fluid, stiffness of the drill pipe (Young's Modulus), hole curvature (dog leg severity), rotational speed of the drill pipe in the casing, rate of advancement downhole (sliding or rotating), the moment of inertia of the drill pipe, the wall thickness of the drill pipe, the boundary conditions describing how the bit is reacting to the formation at the bottom of the well, as well as other parameters. Several commercially available software packages predict buckling load for drill strings.

Some analytical models of buckling identify the importance of the unsupported length of the drill pipe as having a strong influence on the buckling load. Methods have been used to effectively reduce the unsupported length of drill pipe or otherwise for increasing the buckling load. Specifically, for some applications thicker wall thickness pipe is used, and in other designs stabilizer blades are placed in the drill string between drill pipe points. In other design used by Western Well Tool, a non-rotating drill pipe protector is placed in the center of the drill pipe.

The use of non-rotating drill pipe protectors to prevent buckling has been successful in increasing the buckling load, but at a cost. First, non-rotating drill pipe protectors are expensive and can be subject to damage because of the extremely high side loads at or near buckling.

Rotating protectors are typically not used to prevent buckling. Typically, rotating protectors are placed within 10 feet of the tool joints in both the 31 foot length (Range 2 drill pipe) and 45 foot length (Range 3) drill pipe. The reason is that existing rotating drill pipe protectors have poor gripping capability and cannot withstand the loads seen at or near buckling.

The present invention addresses the problems of providing a means to effectively reduce the unsupported length, resisting the resulting side loads on the drill pipe from large compressive loads, and performing these tasks economically, using the rotating drill pipe protector of this invention.

SUMMARY OF THE INVENTION

Briefly, one embodiment of the invention comprises a rotating drill pipe protector which includes a generally cylindrical sleeve-like protective wall structure adapted for mounting to a rotating drill pipe. The wall structure has at least one axial split opening along one side for use in opening and closing the protective wall structure around a drill pipe. A first elongated axial rigid hinge bar is embedded in the wall structure along a first side of the split opening. A second elongated axial rigid hinge bar is embedded in the wall structure on a second side of the split opening. Separate axially spaced apart fasteners extend laterally from the first hinge bar to the second hinge bar. The first hinge bar contains separate axially spaced apart captive sections for retaining corresponding ones of the fasteners. The second hinge bar contains separate axially spaced apart receptor sections for receiving corresponding ones of the fasteners which are rotatable in unison into alignment with the receptor sections via rotation of the first hinge bar. The aligned fasteners are adjusted in a corresponding receptor section to a tightened position that draws opposite sides of the split opening together to apply and maintain a gripping force from the wall structure around the drill pipe. The fasteners are confined within the outer circumference of the wall structure when in the tightened position applying the gripping force to the drill pipe.

After closing and rotating the fasteners into engagement with the hinge bar receptor sections, the fasteners are tightened to produce a holding force around the drill pipe that is much greater than the wedge pin method commonly found in current RDPPs. In one embodiment, the hinged rotating protector of this invention, tightened around a drill pipe at 25 ft-lbs., produces a gripping strength that resists axial slippage at applied loads greater than 10,000 ft-lbs.

In other embodiments, the rotating drill pipe protector of this invention, because of its substantial gripping strength, can be used in applications for preventing buckling of drill pipe.

These and other aspects of the invention will be more fully understood by referring to the following detailed description and the accompanying drawings.

DETAILED DESCRIPTION

Figure 1:
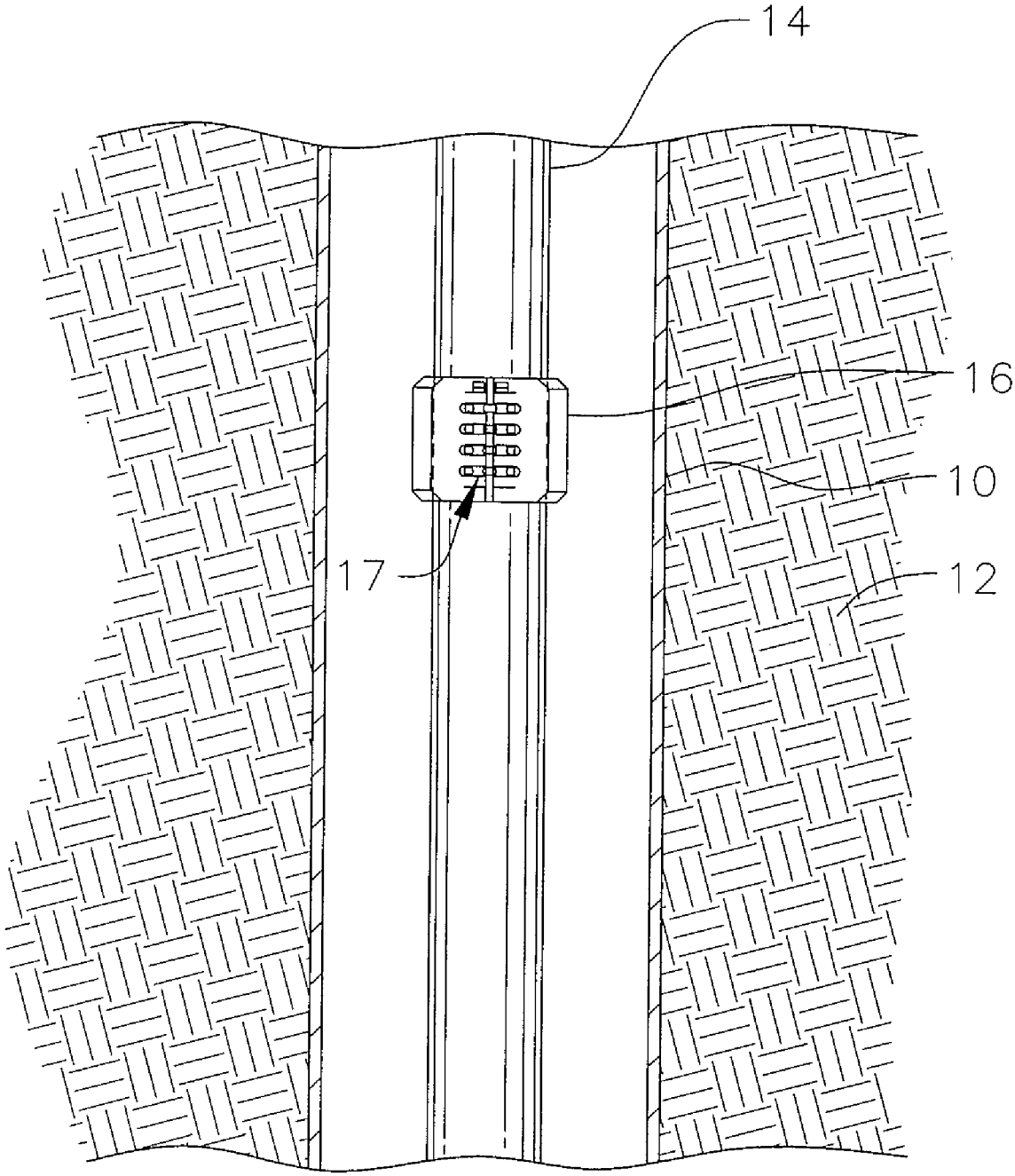
FIG. 1 is a cross-sectional view showing a rotating drill pipe protector secured to a drill pipe located in a well casing of a well bore.

FIG. 1 illustrates a well bore comprising a casing 10 in an underground formation 12 during oil well drilling operations. This is one illustrated use of the invention which also can be used in under water drilling operations. A rotating drill pipe 14 in the casing or well bore has a drill bit (not shown) at the bottom, for drilling the well bore. A rotating drill pipe protector (RDPP) 16 is secured to the drill pipe for protecting the drill pipe and casing from abrasion damage during use, as is well known in the art.

Generally speaking, the rotatable drill pipe protector 16 comprises an elongated cylindrical sleeve made from a protective low friction material which is molded into its desired configuration around an internal reinforcing cage structure, as described below. The sleeve is fastened to the drill pipe by an attachment and fastener assembly 17 for securing the sleeve in a fixed stationary position on the drill pipe. The exterior of the sleeve preferably includes molded axial grooves circumferentially spaced apart around the sleeve, for enhancing flow past the sleeve during use.

The sleeve is made from any of a variety of low friction, non-abrasive materials that protect the drill pipe from damage under contact with the well bore or casing. Suitable materials generally include thermoplastics, thermosetting resinous materials, and/or elastomeric materials, which can include polyurethane, thermoplastic elastomers, rubber, epoxy, fluoropolymers including PTFE, acrylics, polyolefins including polyethylene and polypropylene, nylon, polyester, polyurea, ethylene vinyl acetate, ABS, or a composite comprising one or more of these materials.

Figure 2:
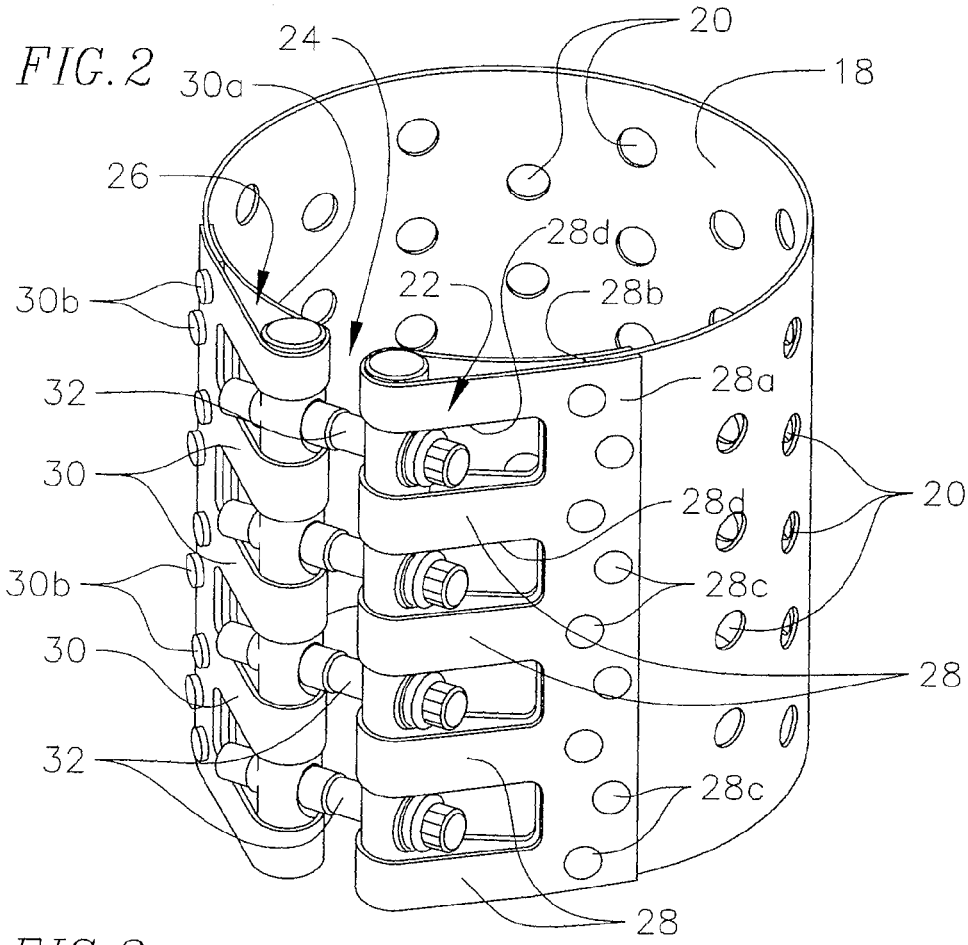
FIG. 2 is a perspective view showing a cage structure having a hinged attachment and fastener assembly.

FIG. 2 illustrates a cylindrical metal reinforcing cage 18 which is made from sheet metal, preferably steel. The cage is embedded in the molded wall structure of the RDPP during the process of molding the sleeve around the reinforcing cage. The cage includes a pattern of bore holes 20 which are filled with the molding material used in forming the RDPP, for interlocking the reinforcing cage internally within the RDPP. The cage also includes a first hinge section 22 along a first side of the axial opening 24 and a second hinge section 26 along a second side of the opening 24. The first hinge section 22 includes axially spaced apart, elongated and laterally extending wrap-around hinge elements 28 which wrap around a first hinge bar described below. Similarly, the second hinge section 26 includes axially spaced apart, elongated and laterally extending hinge elements 30 that wrap around a second hinge bar also described below. The wrap-around hinge elements 28 of the first hinge section 22 are preferably stamped from a flexible sheet metal piece **28*a* wrapped or folded into a generally U-shape to form open loop hinges at the base of each U, aligned vertically for receiving the vertically positioned hinge bar, as described below. The flat inner ends of the U-shaped metal piece 28*a* are positioned on opposite sides of the cage 18, inboard from a vertical edge 28*b* of the cage. An array of fasteners 28*c* rigidly affix the opposite ends of the wrap-around metal piece 28*a* to the cage so as to sandwich the end portion of the cage between them. The wrap-around cage in the vicinity of the U-shaped base is notched at 28*d* to form the open loop hinge elements 28*a***.

The open loop hinge elements 30, on the other side of the sleeve opening 24, are similarly constructed and include a flexible U-shaped folded metal piece **30*a* secured by fasteners 30*b*** along the vertical end portion of the cage.

FIG. 2 also shows fasteners 32, preferably elongated threaded bolts, extending between opposite sides of the split opening 24. The bolts are made of rigid materials such as steel, bronze, aluminum or nylon.

Figure 3:
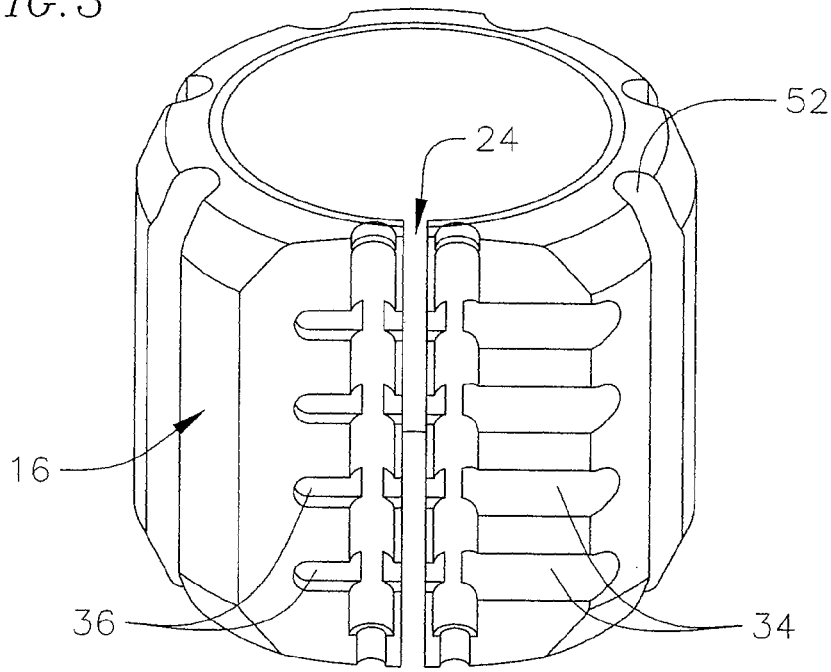
FIG. 3 is a perspective view of a front cut-away section showing a rotating drill pipe protector in an open position prior to assembly of hinge bars and fasteners.

FIG. 3 is a front cut-away view showing the RDPP 16. This view, similar to FIG. 2, shows laterally extending and axially spaced apart slotted openings 34 extending away from the first side of the split opening 24, and corresponding laterally extending and axially spaced recessed openings 36 extending away from the second side of the split opening 24. These slotted and recessed openings are molded into the material that makes up the RDPP, and in use they contain the fasteners 32 so they are positioned within the confines of the outer circumference of the RDPP when fastened in the use position.

Figure 4:
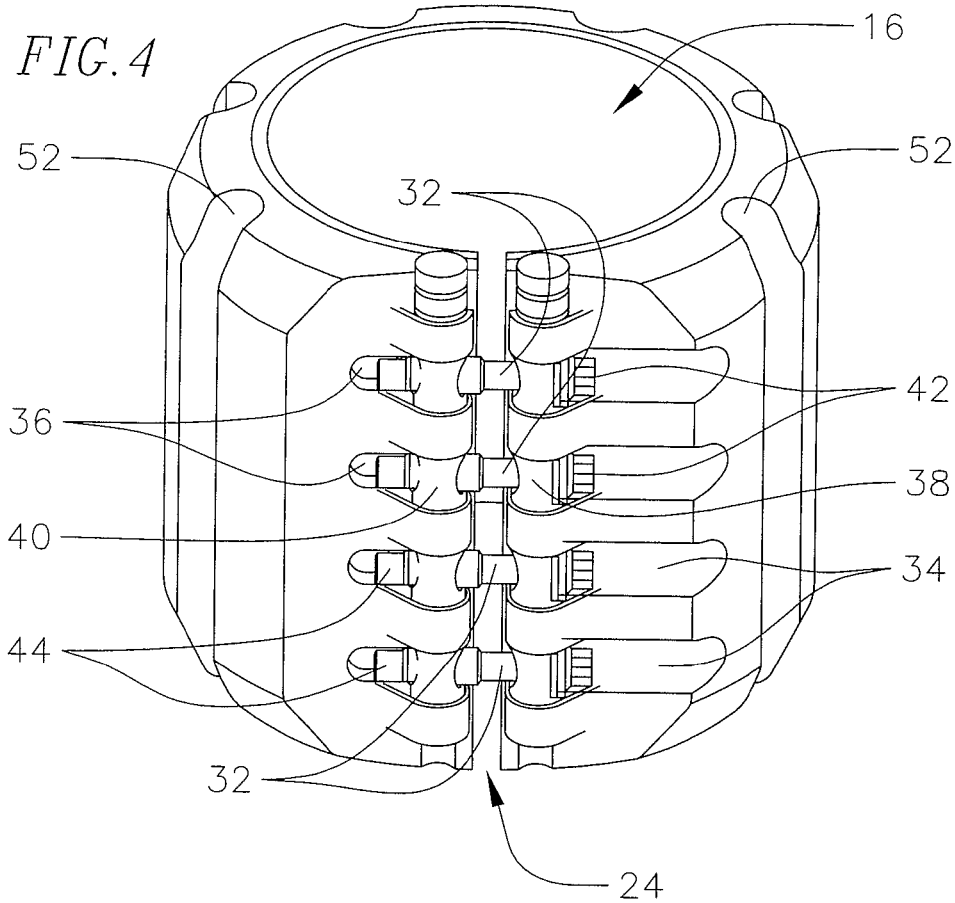
FIG. 4 is a perspective view, similar to FIG. 3, but showing the rotating drill pipe protector with the hinge bars and fasteners in an assembled position.

Referring to FIG. 4, a first axially extending hinge bar 38, also referred to as a rotatable hinge bar, is disposed within a first hinge section of the RDPP, which includes the first hinge section 22 of the reinforcing cage 18. A second axially extending hinge bar 40 is a fixed (or stationary) hinge bar disposed inside a second hinge section of the RDPP, which contains the second hinge sections 24 of the reinforcing cage 18.

The fasteners 32, which are preferably formed as elongated threaded bolts, are held captive in corresponding threaded openings in the rotatable hinge bar 38. The hinge bar 38 has a series of flats milled into it to allow the bolt heads to rest flat against the hinge bar. The bolts extend laterally across the split opening 24 and into alignment with corresponding threaded receptor openings in the fixed hinge bar 40. As shown in FIG. 4, the bolt heads 42 of the fasteners 32 are received in the slotted regions 34 of the RDPP. The threaded ends 44 of the bolts 32 are contained in the recessed regions 36 on the other side of the split opening 24 in the RDPP.

In use, the fasteners are initially inserted into the respective openings of the rotatable hinge bar 38 which rotates about its axis to swing the bolts clear of the opening 24, either toward or away from the second hinge bar 40 on the other side of the opening 24. Rotation of the first hinge bar 38 about its axis can therefore rotate the bolts in unison to a position in alignment with the corresponding threaded receptor openings in the second fixed hinge bar 40. The bolts 32 then can be threaded into the corresponding receptor openings in the second hinge bar, to the assembled position shown in FIG. 4, where further tightening of the bolts can cause the sleeve-like protector to be drawn against the drill pipe to apply a circumferential gripping force around the drill pipe.

Figure 5:
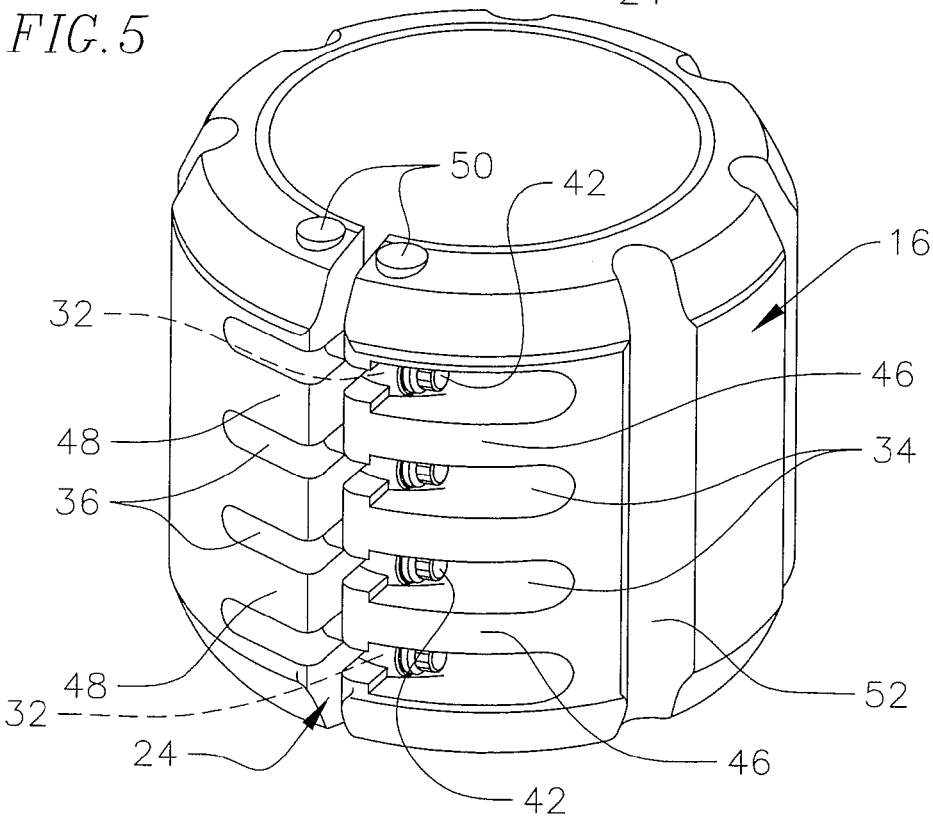
FIG. 5 is a perspective view showing the drill pipe protector in a finished, assembled position.

FIG. 5 shows a finished assembled position of the RDPP. This view shows the molded hinge elements 46 (reinforced by the stamped sheet metal piece 28*a* on the first hinge section 22 of the cage structure) wrapped around the first (rotatable) hinge bar 38, and the molded second hinge elements 48 (reinforced by the stamped sheet metal piece 30*a* on the second hinge section 24 of the cage structure) wrapping around the second (stationary) hinge bar 40. This view also illustrates the heads of the fasteners 32 recessed in the first set of slotted openings 34 on one side of the split opening 24, and the ends of the fasteners recessed in second set of hinge openings 36 on the other side of the opening 24. This view also illustrates plug elements 50 at the top of each hinge bar for use in retaining the hinge bars in the RDPP.

The hinges formed by the sheet metal pieces 28*a* and 30*a* are one embodiment. The hinges also can be made separately or in one piece as part of the cage. They are folded over so that both sides of the hinge meet at a point away from the hinge bar so the hinge can transfer the tensile loads within the fasteners into hoop loads in the structure of the protector sleeve so that it effectively grips the drill pipe. The hinge can be riveted, fastened, or welded to form the closed loop that contains the hinge bar.

Figure 6:
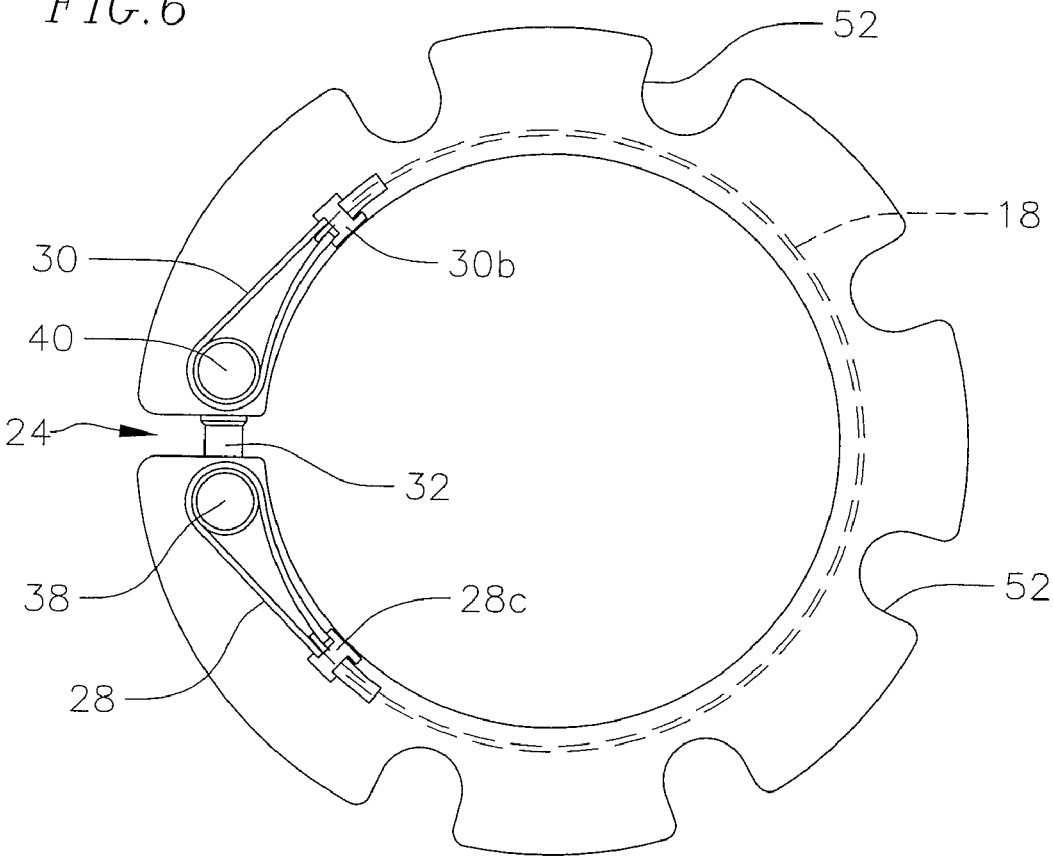
FIG. 6 is a top plan view schematically illustrating a cross-section of the rotating drill pipe protector containing a cage and hinge structure.

FIG. 6 illustrates a schematic cross-section of the RDPP. This view shows the cage 18 embedded in the wall structure of the RDPP 16. The ends of the cage include (1) the wrap-around hinge sections 28 which form the open loops which reinforce the first hinge section of the sleeve that contain the first hinge bar 38, and (2) the wrap-around hinge sections 30 which contains the second hinge bar 40. This view also illustrates the uppermost of the fasteners 32 extending between the hinge bars across the split opening 24.

FIG. 6 also illustrates the cross-sectional configuration of the axial groves 52 formed in the outer surface of the rotating drill pipe protector.

The fastener system comprises a captive bolt containment system which includes oversized tapped threaded openings in the rotating hinge bar, with stepped shank portions on the bolts for preventing disengagement of the bolts when the RDPP is in the open position. Smaller diameter threaded end portions of the bolts and counter-bores in the receiving holes of the non-rotating hinge bar prevent misalignment of the bolts when engaged.

Figure 7:
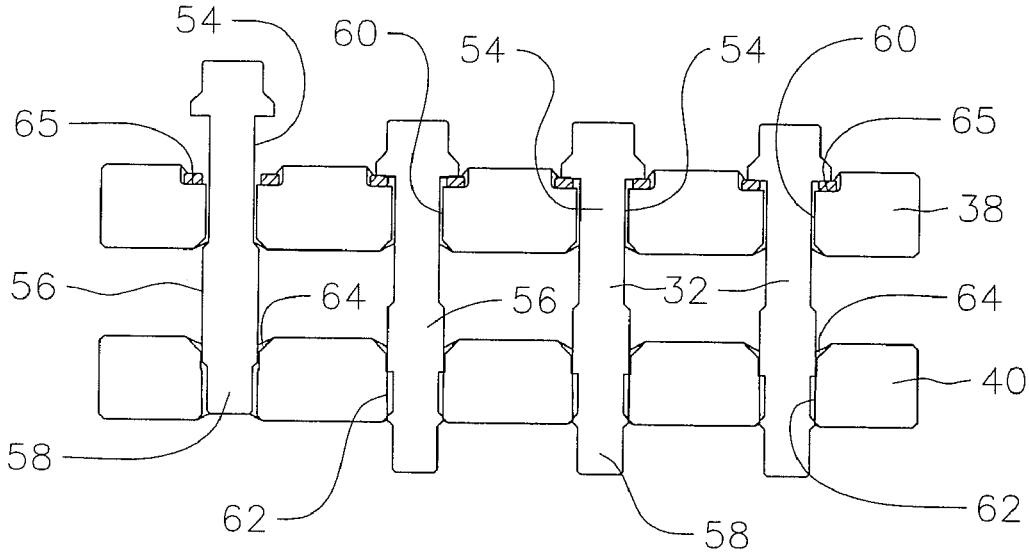
FIG. 7 is a schematic side elevational view illustrating different steps in a captive bolt containment system.
Figure 8:
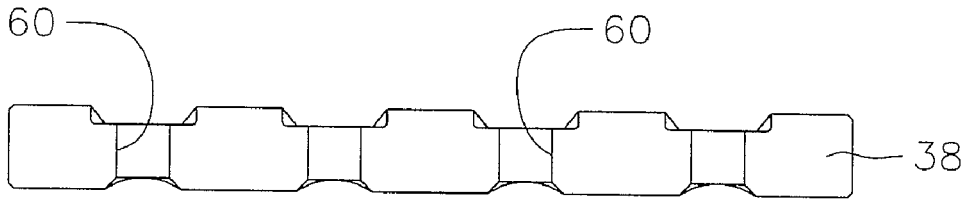
FIG. 8 is a schematic view of the containment system used in a rotating hinge bar.
Figure 9:
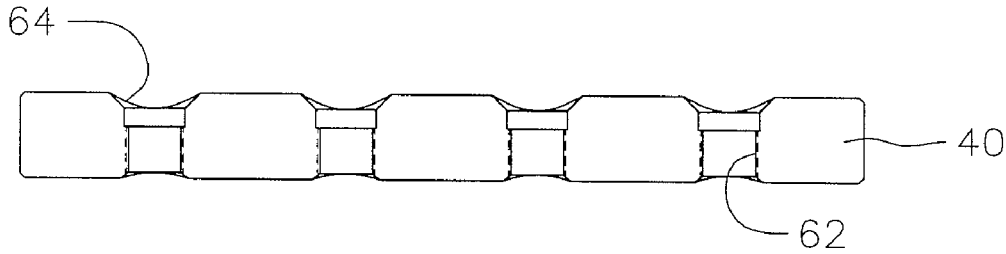
FIG. 9 is a schematic view illustrating a containment system for the hinge bar containing the fastener receiving holes.
Figure 10:
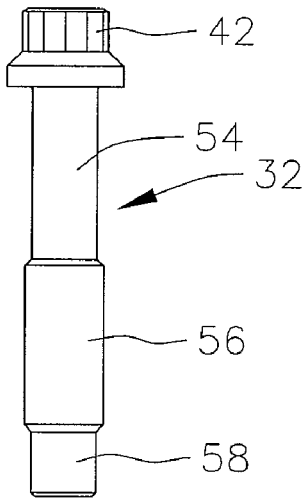
FIG. 10 is a schematic view illustrating a fastener profiled to provide a means of containment and means of preventing misalignment of the fasteners during assembly.

FIGS. 7 through 10 illustrate the captive bolt containment system. Referring first to FIG. 7, each fastener bolt 32 includes a stepped shank portion 54, an enlarged threaded shank portion 56, and a stepped tip 58 of reduced cross-section. The arrangement shown in FIG. 7 shows the fastener on the left side disengaged and in a position free to spin. The other three fasteners shown in the same illustration show the bolts in their engaged position. This view shows an oversized through-hole 60 with a tapped thread in the first hinge bar 38 aligned with a threaded bore 62 in the second hinge bar, a counter-bore 64 leading into each threaded hole 62 of the second hinge bar 40, and a lock washer 65 for securing the bolt head of each bolt in its tightened position.

The through-diameter of the thread in the through-hole 60 in the first hinge bar is great enough to allow a free fit between the thread in the first hinge bar 38 and the stepped shank 54 of the bolt. When the bolts pass through the first hinge bar, the threads in the first hinge bar prevent the bolts from falling out when handling. The diameter of the stepped shank 54 is close to that of the minor diameter of the bolt thread. The stepped tip 58 of the bolts assists in alignment in unison with the holes in the second hinge bar. The oversized tapped thread on the first hinge bar, along with the stepped shank 54 on the bolt between the bolt head and thread, retains the bolts when in the non-installed position.

The counter-bore in the second hinge bar creates a flat surface to set the threads against, reducing the likelihood of cross-threading upon initial engagement.

The length of the threaded portion 56 of the bolt is less than the distance between the thread on the first hinge bar and the second hinge bar. This allows the fastener to disengage from the second hinge bar and still be contained by the first hinge bar.

The hinge design of the present invention includes the reinforcing cage with hinge sections folded over a larger diameter hinge bar than the thinner stamped steel wedge pin design. This results in lower stress concentrations and, therefore, greater strength. Also, the fasteners and other structural parts of the present invention are encased in and protected by the body of the protector itself, making it less likely to be damaged by protrusions, debris, or obstructions that may exist in a well.

Thus, the invention provides an attachment and fastener system for rigidly securing a rotatable drill pipe protector (RDPP) to a drill pipe adapted for rotating in a well bore or casing. The drill pipe protector comprises a sleeve-like wall structure which is split axially along at least one side. A pair of elongated parallel hinge bars are contained in first and second hinge sections which wrap around the hinge bars along opposite sides of the split opening in the RDPP. One hinge bar is rotatable in its hinge section. A series of axially spaced apart bolts are held in corresponding threaded openings in the rotatable hinge bar which rotates about its axis in its hinge to swing the bolts between open and closed positions. The other hinge bar has a series of threaded receptor openings facing outwardly from slotted openings in the hinge section which are aligned with the bolts on the other side of the opening. The rotating hinge bar swings the bolts in unison into alignment with the slotted openings in the other hinge, after which the bolts are tightened in the threaded receptor openings for applying a holding force around the drill pipe. The hinges which wrap around each hinge bar are formed on the ends of a reinforcing cage structure molded into the wall of the RDPP.

The rotating drill pipe protector of this invention generally can be manufactured as follows:

- The inside diameter (when assembled) is equal to the OD of the drill pipe.
- The outside diameter of the drill pipe protector is equal to the OD of the drill pipe tool joint plus a minimum of 0.5 inch or more, preferably about 0.75 inch greater. This provides the "standoff" or the amount that the OD of the protector is greater than the tool joint.
- The length of the protector is greater than the diameter of the drill pipe, preferably a length approximately equal to the diameter of the drill pipe tool joint. In other embodiments, the length can be from about 5 to about 15 diameters long.
- The threaded bolts 32 as used in the drill pipe protector are preferably about ⅜-inch diameter, 1¾ inches long, and made of 110 ksi yield strength material.
- The hinge bars 38 and 40 can be made from ⅝-inch diameter stock grade steel with a length of about 1 inch shorter than the length of the rotating drill pipe protector.
- In one example, a 5.0-inch diameter RDPP of this invention can have the following dimensions:
  ID=5 inches
  OD=7.25 inches
  Lengths=6.5 inches The torque used to tighten the RDPP to a 5.0-inch drill pipe can be from 15 to 40 ft-lbs. between 20-30 ft-lbs. and more preferably about 25 ft-lbs. is a desirable applied torque.

Grip strength of the RDPP was tested by various "push off" tests, by placing the sleeve on a drill pipe test unit to measure slippage on a steel 5.00 inch OD drill pipe sample. A cylinder was placed against the sleeve and increasing forces were applied until the sleeve slipped on the test pipe. These tests were conducted at various levels of torque applied to the sleeve. A comparison test was made between the RDPP of this invention and the wedge pin design commonly used commercially. Both protectors were installed per manufacturer's recommendations. A four-bolt hinged rotating protector, according to this invention, tightened to 25 ft-lbs., slipped at 10,000 to 12,000 lbs. in such grip strength testing. By comparison, the wedge pin type protector described previously, tightened to 25 ft-lbs., slipped at 2000 to 3000 lbs. Other commercial rotary drill pipe protectors began to slip at 1000 to 2000 lbs. push off loads.

A series of tests have been performed to determine wear-life characteristics of various hardness of materials, specifically various polyurethanes. In general, it was concluded that materials with a Shore Hardness of 80 have a superior wear strength in drill pipe casing compared to harder materials, for example, those having a hardness of 92 or 95. A preferred embodiment is to use a softer hardness material in the range of about 75 to 85, and more preferably, about 80 Shore Hardness, including both plastics and elastomers.

The rotating drill pipe protector of this invention can be used for buckling prevention. Each drill string comprises long lengths of unsupported drill pipe sections extending between tool joints at opposite ends of the length of pipe. As mentioned previously, the long length of the drill pipe can be subject to buckling during use. The rotating drill pipe protector of this invention can be positioned strategically between the tool joints on the otherwise unsupported length of pipe to resist bending or buckling of the drill string during use. Positioning of the drill pipe protector on the length of pipe, in essence, shortens the bending length of the pipe between the joints.

It is recognized that drill pipe protectors positioned close to the tool joints can be subject to too much abuse during use. Drill pipe protectors placed farther from the tool joints may be subject to slippage, but the rotating drill pipe protector of this invention provides substantial holding force to prevent slippage when the drill pipe protector is positioned between the tool joints to prevent buckling.

One embodiment of the invention provides a method of placement of the rotating drill pipe protector at a location (or locations) that effectively maximizes the reduction of unsupported length of drill pipe. More specifically, one or more rotating protectors are placed beyond 10 feet from the tool joint, and the preferred embodiment is approximately the middle of a typical unsupported drill pipe section. In other applications, such as with small diameter drill pipe, or when very high buckling loads are required, it may be useful to place more than one rotating protector on a section of drill pipe between tool joints. For example, two rotating protectors could be placed at locations that approximately divide the drill pipe section between tool joints into three equal parts.

In general, only specific regions of a drill string within casing would need rotating drill pipe protectors to increase the buckling load. The selection of these regions would be accomplished by the use of commercially available software programs used for drill string analysis. Thus, the cost of rotating protectors for use in buckling prevention is reduced.

Figure 11:
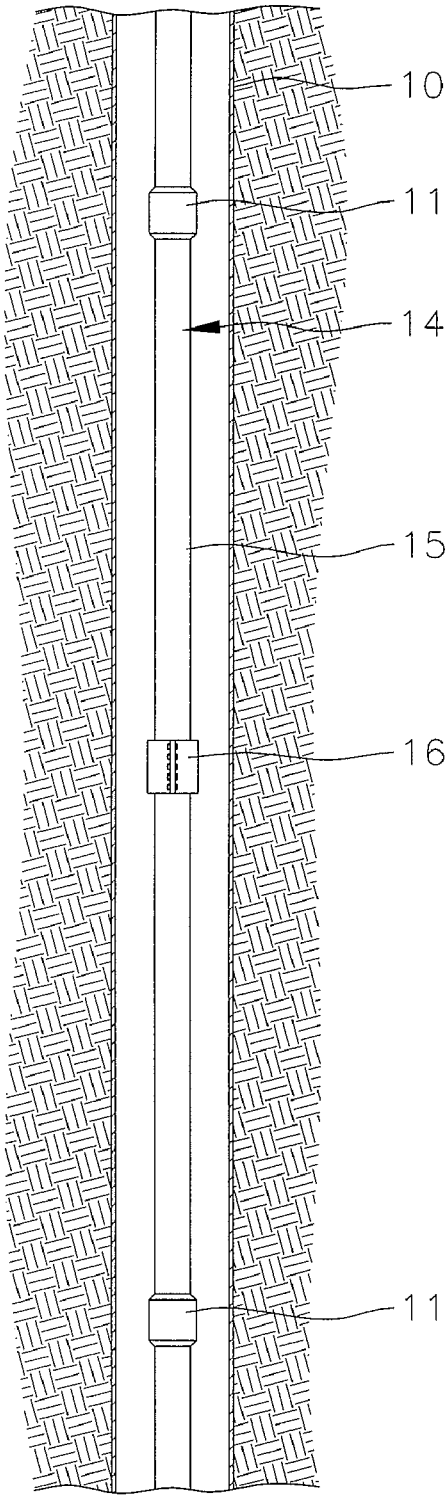
FIG. 11 is a schematic view showing a rotating drill pipe protector secured to a drill pipe located in a well bore and positioned so as to prevent buckling of the drill string.

FIG. 11 is one embodiment of the invention in which the rotating drill pipe protector 16 is positioned on a drill string 14 to prevent buckling of the drill string during use. In this embodiment, a length of drill pipe 15 extends between the tool joints 11 at opposite ends of the length of pipe. Such length of pipe may be about 30 to 31 feet long, unsupported between the tool joints. In this instance, the rotating drill pipe protector 16 can be positioned substantially in the middle of the pipe section, i.e., about 15 to 16 feet from each tool joint. The gripping force of the rotating drill pipe protector can resist slippage during use while reducing to about one-half the bending length of the pipe section. More generally, the rotating drill pipe protector can be positioned greater than 10 feet from either tool joint and provide a level of buckling prevention.

Figure 12:
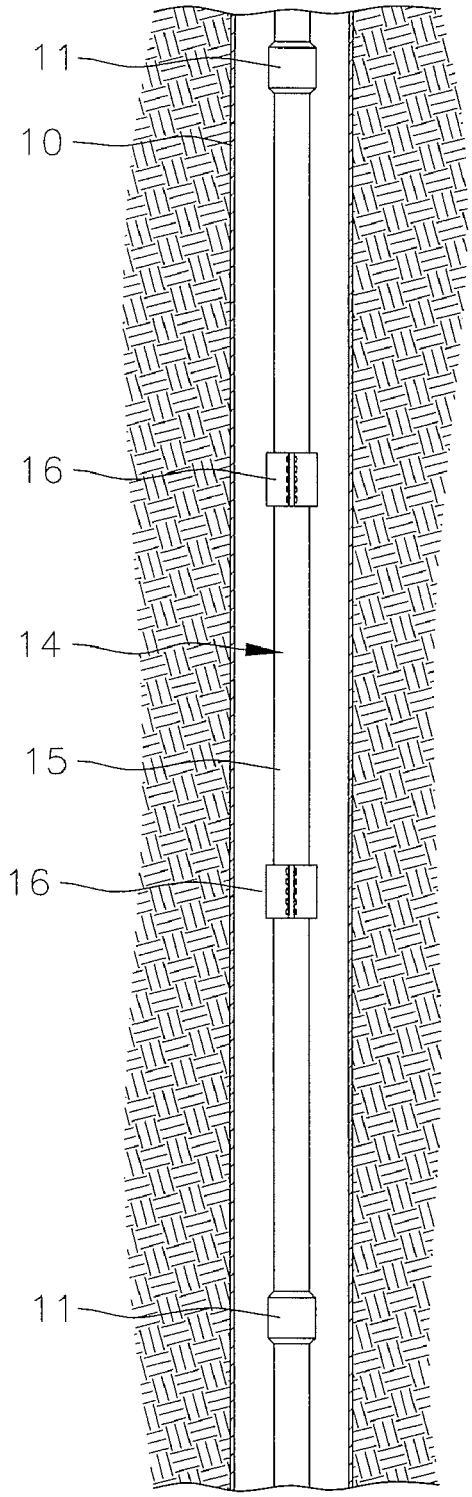
FIG. 12 is a schematic view similar to FIG. 11 but showing multiple rotating drill pipe protectors positioned on a drill string so as to prevent buckling during use.

FIG. 12 is another embodiment of the invention in which a length of drill pipe 15, which is longer than the pipe section shown in FIG. 11, extends between tool joints 11 at opposite ends of the longer length of pipe. This pipe section can have a length of approximately 45 feet unsupported between the tool joints. In this instance, a pair of rotating drill pipe protectors 16, according to this invention, are positioned at generally equally spaced apart locations on the pipe section, i.e., about 15 feet between each other and about 15 feet from the closest tool joint. Again, the rotating drill pipe protectors can resist slippage during use because of their substantial gripping strength while reducing the effective bending length of the pipe section extending between the tool joints.

What is claimed is:

1. A rotating drill pipe protector comprising:

an annular protective sleeve-like wall structure adapted to encompass a drill pipe for rotating in a well bore or casing, the wall structure having at least one axial split opening along one side for use in opening and closing the protective wall structure around the drill pipe, an elongated first hinge bar secured to a first hinge section of the wall structure along one side of the split opening, an elongated second hinge bar secured to a second hinge section of the wall structure along an opposite side of the split opening, and a reinforcing cage made of sheet metal embedded in the annular wall structure, the reinforcing cage having a first end section adjacent the first hinge bar and a second end section adjacent the second hinge bar, the first hinge section further including a separate generally U-shaped first wrap-around hinge section made of sheet metal and having (1) vertically spaced apart open-ended hinge elements at the base of the U containing the first hinge bar and (2) first inner end sections inboard from the U sandwiching the first end section of the reinforcing cage, the first inner end sections rigidly affixed to the first end section of the reinforcing cage, the second hinge section further including a separate generally U-shaped second wrap-around section made of sheet metal and having (1) vertically spaced apart open-ended hinge elements at the base of the U containing the second hinge bar and (2) second inner end sections inboard from the U sandwiching the second end section of the reinforcing cage, the second inner end sections rigidly affixed to the second end section of the reinforcing cage, the first hinge bar rotatable about an axis in the hinge elements of the first hinge section, the first hinge bar containing one or more captive sections for retaining one or more elongated fasteners extending from the first hinge bar toward the second hinge bar, the first hinge bar rotatable to swing the one or more fasteners toward or away from the second hinge bar, the second hinge bar containing one or more fastener receptors for receiving one or more of the fasteners rotated into alignment with a corresponding receptor on the second hinge bar, the one or more fasteners adjustable in a corresponding receptor to draw opposite sides of the split opening closer together to apply a progressive gripping force from the wall structure of the rotating drill pipe protector around the drill pipe.

2. Apparatus according to claim 1 in which, the reinforcing cage and the first and second inner end sections thereof are embedded in the sleeve-like wall structure.

3. Apparatus according to claim 2 in which the reinforcing cage and the first and second end sections thereof are molded in a non-abrasive synthetic resinous or elastomeric material forming the sleeve-like wall structure.

4. Apparatus according to claim 1 in which the first hinge bar contains a series of axially spaced apart first threaded openings forming the captive sections thereof; the separate fasteners secured to the first threaded openings, and in which the second hinge bar contains a series of axially spaced apart second threaded openings forming the fastener receptors thereof.

5. Apparatus according to claim 1 in which the fasteners are threaded bolts having their bolt heads captured in portions of the first hinge bar between the first wrap-around metal reinforcing portions of the first hinge section.

6. Apparatus according to claim 1 in which the fasteners have a configuration for retaining them in the first hinge bar when the protective sleeve is in its open position, and in which the receptors on the second hinge bar are configured to prevent misalignment of the fasteners, when the first hinge bar rotates the fasteners toward the second hinge bar.

7. Apparatus according to claim 1 in which the drill pipe protector is adapted to apply an excess of 10,000 ft-lbs. of gripping force to a 5-inch diameter drill pipe.

8. An underground well drilling system comprising a well bore foamed in an underground formation, a rotatable drill string positioned in the bore and carrying a rotatable drill bit, and a rotating drill pipe protector, according to claim 1, secured to a section of drill pipe on the drill string.

9. The well drilling system according to claim 8 in which the drill pipe section extends unsupported between a pair of tool joints at its opposite ends; and in which the rotating drill pipe protector is positioned on the drill pipe section more than 10 feet away from either tool joint, to prevent buckling of the drill pipe.

10. A method for preventing buckling of a drill string positioned in a well bore, in which the drill string comprises one or more sections of drill pipe, each section positioned between tool joints, the method including securing the rotatable drill pipe protector of claim 1 to the drill pipe section, between tool joints, more than 10 feet away from either tool joint.

11. The method according to claim 10 including securing more than one of the drill pipe protectors to the drill pipe section, between the tool joints.

12. A method of drilling a well in an underground formation comprising positioning a drill string in a well bore, the drill string including one or more sections of drill pipe, each section positioned between tool joints, and securing more than one of the drill pipe protectors, according to claim 1, to the drill pipe sections, between the tool joints.

13. A rotating drill pipe protector comprising:

an annular sleeve-like protective wall structure adapted for mounting to a rotating drill pipe, the wall structure having at least one axial split opening along one side for use in opening and closing the protective wall structure around the drill pipe, the annular wall structure having an outer circumference, a first elongated axial rigid hinge bar embedded in a first hinge section of the wall structure along a first side of the split opening, the first hinge bar rotatable about its axis in the first hinge section;

a second elongated axial rigid hinge bar embedded in a second hinge section of the wall structure along a second side of the split opening, a reinforcing cage made of sheet metal embedded in the annular wall structure, the reinforcing cage having a first end section adjacent the first hinge bar and a second end section adjacent the second hinge bar, the first hinge section further including a generally U-shaped first wrap-around hinge section made of sheet metal and having (1) vertically spaced apart open-ended hinge elements at the base of the U containing the first hinge bar and (2) first inner end sections inboard from the U sandwiching the first end section of the reinforcing cage, the first inner end sections rigidly affixed to the first end section of the reinforcing cage, the second hinge section further including a separate generally U-shaped second-wrap around section made of sheet metal and having (1) vertically spaced apart open-ended hinge elements at the base of the U containing the second hinge bar and (2) second inner end sections inboard from the U sandwiching the second end section of the reinforcing cage, the second inner end sections rigidly affixed to the second end section of the reinforcing cage, and separate axially spaced apart fasteners extending laterally from the first hinge bar toward the second hinge bar, the first hinge bar containing separate axially spaced apart captive sections for retaining corresponding ones of the elongated fasteners, the second hinge bar containing separate axially spaced apart receptor sections for receiving corresponding ones of the elongated fasteners which are adjustable in a corresponding receptor section to a tightened position that draws opposite sides of the split opening together to apply a circumferential gripping force from the wall structure around the drill pipe, the fasteners confined within the outer circumference of the wall structure when in the tightened position applying the gripping force to the drill pipe.

14. Apparatus according to claim 13 in which the drill pipe protector is adapted to apply an excess of 10,000 ft-lbs. of gripping force to a 5-inch diameter drill pipe.

15. Apparatus according to claim 13 in which the hinge bars and fasteners of the protector can be tightened around a 5-inch diameter drill pipe at a torque in excess of 20 ft-lbs.

16. An underground well drilling system comprising a well bore formed in an underground formation, a rotatable drill string positioned in the bore and carrying a rotatable drill bit, and a rotating drill pipe protector, according to claim 13, secured to a section of drill pipe on the drill string.

17. The well drilling system according to claim 16 in which the drill pipe section extends unsupported between a pair of tool joints at its opposite ends; and in which the rotating drill pipe protector is positioned on the drill pipe section more than 10 feet away from either tool joint, to prevent buckling of the drill pipe.

18. The well drilling system according to claim 17 in which the drill pipe section extends unsupported between a pair of tool joints at its opposite ends; and in which more than one of the rotating drill pipe protectors are positioned on the drill pipe section, between the tool joints, so as to prevent buckling of the drill pipe.

19. A method for preventing buckling of a drill string positioned in a well bore, in which the drill string comprises one or more sections of drill pipe between tool joints, the method including securing the rotatable drill pipe protector of claim 13 to the drill pipe section, between tool joints, more than 10 feet away from either tool joint.

20. A rotating protector for wellbore tubing comprising:

an annular protective sleeve-like wall structure adapted to encompass a wellbore tubing, the wall structure made from an elastomeric or polymeric material, the wall structure having at least one axial split opening along one side for use in opening and closing the protective wall structure around the tubing, an elongated first hinge bar secured to a first hinge section of the wall structure along one side of the split opening, an elongated second hinge bar secured to a second hinge section of the wall structure along an opposite side of the split opening, and a reinforcing cage made of sheet metal embedded in the annular wall structure, the reinforcing cage having a first end section adjacent the first hinge bar and a second end section adjacent the second hinge bar, the first hinge section further including a separate generally U-shaped first wrap-around hinge section made of sheet metal and having (1) vertically spaced apart open-ended hinge elements at the base of the U containing the first hinge bar and (2) first inner end sections inboard from the U sandwiching the first end section of the reinforcing cage, the first inner end sections rigidly affixed to the first end section of the reinforcing cage, the second hinge section further including a separate generally U-shaped second wrap-around section made of sheet metal and having (1) vertically spaced apart open-ended hinge elements at the base of the U containing the second hinge bar, and (2) second inner end sections inboard from the U sandwiching the second end section of the reinforcing cage, the second inner end sections rigidly affixed to the second end section of the reinforcing cage, the first hinge bar rotatable about an axis in the hinge elements of the first hinge section, the first hinge bar containing one or more captive sections for retaining one or more elongated fasteners extending from the first hinge bar, between the hinge elements of the first hinge section, and toward the second hinge bar, the first hinge bar rotatable to swing the one or more fasteners toward or away from the second hinge bar, the second hinge bar containing one or more fastener receptors positioned between the hinge elements of the second hinge section, for receiving one or more of the fasteners rotated into alignment with a corresponding receptor on the second hinge bar, the one or more fasteners adjustable in a corresponding receptor to draw opposite sides of the split opening closer together to apply a progressive gripping force from the wall structure of the protector around the wellbore tubing.

* * * * *

UNITED STATES PATENT AND TRADEMARK OFFICE

CERTIFICATE OF CORRECTION

PATENT NO. : 7,938,202 B2
APPLICATION NO. : 12/429962
DATED : May 10, 2011
INVENTOR(S) : Sarah B. Mitchell et al.

It is certified that error appears in the above-identified patent and that said Letters Patent is hereby corrected as shown below:

In the Claims

Column 10, Claim 8, line 18 Delete "foamed" Insert -- formed --

Signed and Sealed this
Twenty-eighth Day of February, 2012

David J. Kappos

David J. Kappos
*Director of the United States Patent and Trademark Office*